US007681339B2

(12) United States Patent
Wakitani et al.

(10) Patent No.: US 7,681,339 B2
(45) Date of Patent: Mar. 23, 2010

(54) SELF-PROPELLED SNOW REMOVER

(75) Inventors: Tsutomu Wakitani, Wako (JP); Toshiaki Kawakami, Wako (JP)

(73) Assignee: Honda Motor Co., Ltd. (JP)

( * ) Notice: Subject to any disclaimer, the term of this patent is extended or adjusted under 35 U.S.C. 154(b) by 681 days.

(21) Appl. No.: 11/493,142

(22) Filed: Jul. 26, 2006

(65) Prior Publication Data

US 2007/0022637 A1 Feb. 1, 2007

(30) Foreign Application Priority Data

Jul. 29, 2005 (JP) ..... 2005-221400

(51) Int. Cl.
*E02F 5/02* (2006.01)
*E01H 5/09* (2006.01)

(52) U.S. Cl. ..... 37/348; 37/245

(58) Field of Classification Search ..... 37/234, 37/235, 245, 271, 309, 352, 348; 172/9, 172/255

See application file for complete search history.

(56) References Cited

U.S. PATENT DOCUMENTS 4,630,685 A * 12/1986 Huck et al. ..... 172/7
4,760,657 A * 8/1988 Ganzmann et al. ..... 37/232
5,036,608 A * 8/1991 Ciula ..... 37/236
5,398,766 A * 3/1995 Nakayama et al. ..... 172/4.5
5,462,125 A * 10/1995 Stratton et al. ..... 172/826
6,112,826 A * 9/2000 Ura et al. ..... 172/255
6,320,497 B1 * 11/2001 Fukumoto et al. ..... 340/425.5
6,718,246 B2 * 4/2004 Griffith et al. ..... 701/50
2005/0127628 A1 * 6/2005 Ramsey ..... 280/86.5

FOREIGN PATENT DOCUMENTS

JP 61011292 1/1984
JP 61030085 2/1986

* cited by examiner

*Primary Examiner*—Robert E Pezzuto
*Assistant Examiner*—Abigail A Risic
(74) *Attorney, Agent, or Firm*—Adams & Wilks

(57) ABSTRACT

A self-propelled snow remover has a machine body, travel units mounted on the machine body to undergo turning movement and linear movement, and at least one steering member mounted to the machine body and operable to turn the travel units. A snow-removing implement is mounted to the machine body to undergo lifting, lowering and rolling movements relative to the machine body. A lift drive mechanism lifts and lowers the snow-removing implement. A control unit controls the lift drive mechanism by issuing a lift drive instruction to the lift drive mechanism so as to automatically lift the snow-removing implement when a steering condition in which the steering member is turned is determined to be satisfied, and by issuing a lowering drive instruction to the lift drive mechanism so as to automatically lower the snow-removing implement when the steering condition is determined to be no longer satisfied.

20 Claims, 13 Drawing Sheets

START
ST01
INITIAL SETTING
C
ST02
CALCULATE ACTUAL HEIGHT POSITION Hr
ST03
CALCULATE ACTUAL TILT POSITION Lr
ST04
Hb←Hr
Lb←Lr
ST05
READ LEFT / RIGHT TURN SWITCH SIGNAL
ST06
IS LEFT-TURN SWITCH ON ?
NO
YES
ST08
IS RIGHT-TURN SWITCH ON ?
NO
YES
ST09
ST07
ACTIVATE LEFT REGENERATIVE BRAKE
ACTIVATE RIGHT REGENERATIVE BRAKE
A

SELF-PROPELLED SNOW REMOVER

FIELD OF THE INVENTION

The present invention relates to a snow remover which is self-propelled and has a travel device and a snow-removing implement.

BACKGROUND OF THE INVENTION

In some self-propelled snow removers, a snow-removing implement is attached to a machine body so as to be capable of lifting, lowering, and rolling, and a travel unit is provided to the machine body. The snow-removing implement is composed of an auger, for example. In a snow remover provided with an auger, a system is adopted whereby the height of the auger is varied according to snow removal circumstances. Elevating the lower surface of the auger when the snow remover is moving enables more efficient travel. On the other hand, lowering the lower surface of the auger during snow removal enables more efficient snow removal. Furthermore, it is often the case that the height of the auger is varied in conjunction with irregularities in the road surface during snow removal. Using human power to vary the height of the auger in this manner places a large burden on the operator.

Techniques for raising and lowering the auger by machine power have been proposed in order to lighten the burden on the operator. Such auger-type snow removers are described in Japanese Patent Laid-Open Publication No. 61-30085 and Japanese Utility Model Laid-Open Publication No. 61-11292.

In the auger-type snow remover described in the 61-30085 publication, the auger is raised and lowered by using an operating lever to operate a hydraulic cylinder for lifting, and the auger is rolled by using the operating lever to operate hydraulic cylinder for rolling.

In the auger-type snow remover described in the 61-11292 publication, an auger case is raised and lowered by a hydraulic cylinder for vertical movement, and the auger case is rolled by a horizontal-movement hydraulic cylinder. When the auger case is tilted to the left or right in relation to the road surface, the auger case is automatically rolled by the horizontal-movement hydraulic cylinder to correct the tilt.

During snow removal using these auger-type snow removers, the operator often turns the snow remover according to the snow removal situation. Because the snow removal operation is under way, the auger and auger housing are lowered to a point near the road surface. When the snow remover is turned in this state, accumulated snow interferes with turning depending on the state of snow accumulated around the snow remover. The auger must therefore be manually raised each time the operator turns the snow remover. Although the auger is lifted and lowered by machine power, there is potential for further improvement in order to further ease the burden placed on the operator.

There is therefore a need for a technique whereby the ability to turn the self-propelled snow remover during the snow removal operation is enhanced, and the burden placed on the operator is further reduced.

SUMMARY OF THE INVENTION

The present invention provides a self-propelled snow remover comprising: travel units capable of turning and moving straight forward; at least one steering member operable to turn the travel units; a machine body on which the travel units are mounted; a snow-removing implement mounted to the machine body in such a manner as to be capable of lifting, lowering and rolling movements; a lift drive mechanism for lifting and lowering the snow-removing implement; and a control unit for controlling the lift drive mechanism, wherein the control unit issues a lift drive instruction to the lift drive mechanism so as to lift the snow-removing implement when it is determined that a condition is satisfied wherein the steering members are turned, and issues a lowering drive instruction to the lift drive mechanism so as to lower the snow-removing implement when it is determined that the aforementioned condition is not satisfied.

Therefore, when the steering members are turned, the snow-removing implement can be raised by the lift drive mechanism in conjunction with the operation of the steering members. In other words, the snow-removing implement can be automatically raised to a relatively high position when the self-propelled snow remover is in a turn. Accordingly, since accumulated snow does not interfere with turning, the ability to turn the snow remover during snow removal can be enhanced.

Afterwards, when the turning operation of the steering members is stopped, the snow-removing implement can be lowered by the lift drive mechanism in conjunction with the completion of the turn operation. In other words, the snow-removing implement can be automatically lowered to a low position when the snow remover has completed the turn. Snow removal can therefore be rapidly resumed.

The snow-removing implement can thus be automatically raised and lowered in accordance with the operation of the steering members. There is no need for the snow-removing implement to be raised and lowered manually each time the operator causes the snow remover to turn back and resume a forward movement. The burden on the operator can therefore be alleviated even further.

It is preferred that the control unit store in memory the height position of the snow-removing implement at the time at which it is determined that the aforementioned condition is satisfied, and issue the lowering drive instruction so as to return the height position of the snow-removing implement to the stored original height position when it is determined that the aforementioned condition is no longer satisfied.

It is also preferred that the snow remover further comprise a rolling drive mechanism for rolling the snow-removing implement, wherein the control unit stores in memory the rolling position of the snow-removing implement at the time at which it is determined that the aforementioned condition is satisfied, and issues an adjustment drive instruction to the rolling drive mechanism so as to match the tilt of the snow-removing implement to the stored original rolling position when it is determined that the aforementioned condition is no longer satisfied.

It is also preferred that the snow remover further comprise a rolling drive mechanism for rolling the snow-removing implement, wherein the control unit issues an adjustment drive instruction to the rolling drive mechanism so as to match the tilt of the snow-removing implement to a pre-set rolling reference position when it is determined that the aforementioned condition is no longer satisfied.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
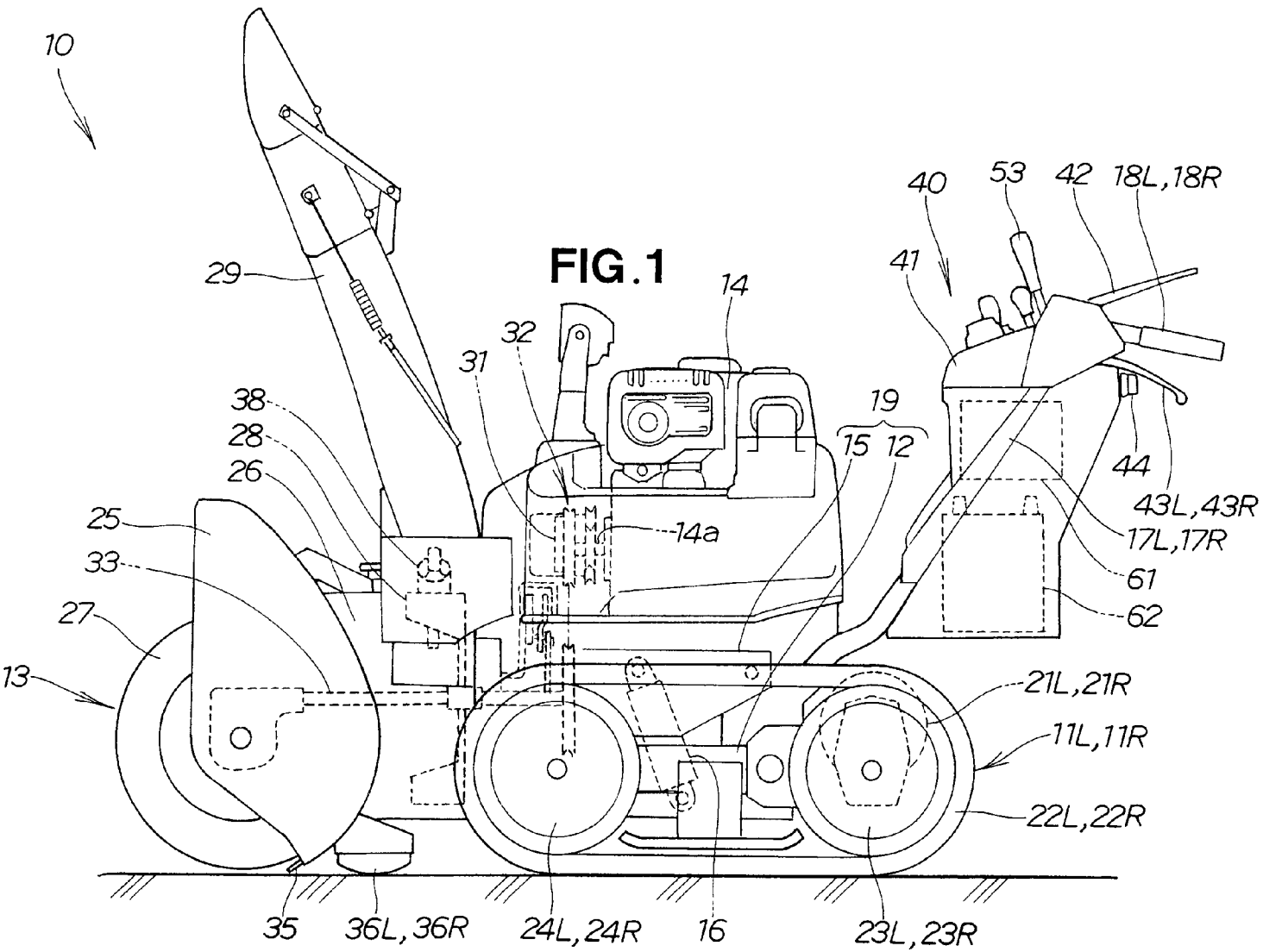
FIG. 1 is a side view of the self-propelled snow remover according to the present invention.
Figure 2:
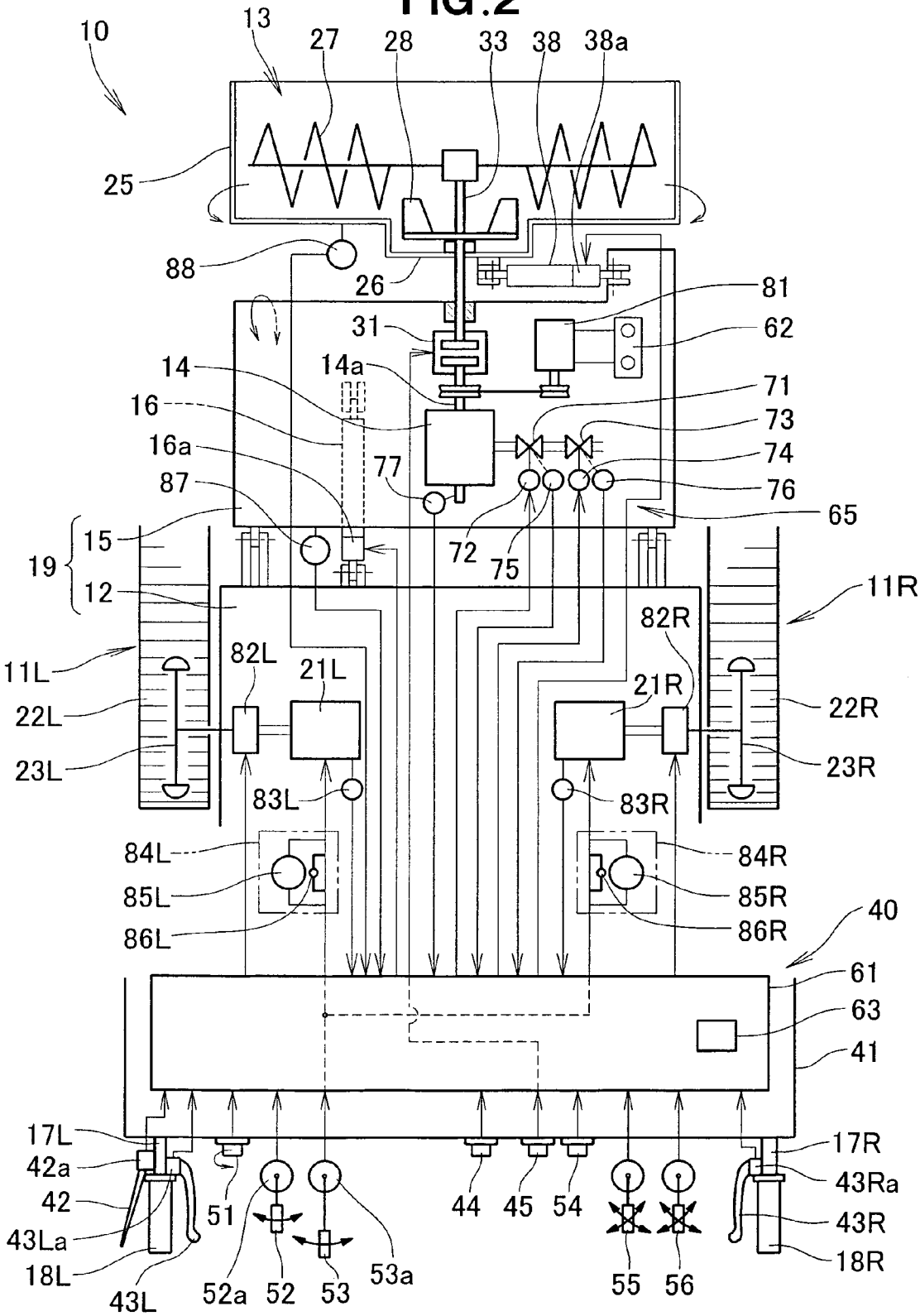
FIG. 2 is a schematic plan view of the self-propelled snow remover shown in FIG. 1.

As shown in FIGS. 1 and 2, the self-propelled snow remover 10 is composed of left and right travel units 11L and 11R, left and right electric motors 21L and 21R for driving the travel units 11L and 11R, an auger-type snow-removing implement 13, an engine 14 for driving the snow-removing implement 13, and a machine body 19. This self-propelled snow remover 10 is referred to as a self-propelled auger-type snow remover. The self-propelled snow remover 10 hereinafter will be referred to simply as the snow remover 10. The snow-removing implement 13 will be referred to simply as the implement 13.

The machine body 19 is composed of a travel frame 12 and a vehicle body frame 15 attached to the travel frame 12 so as to be able to swing vertically about the back end portion thereof. This machine body 19 is provided with a lift drive mechanism 16 for lifting and lowering the front portion of the vehicle body frame 15 in relation to the travel frame 12.

The lift drive mechanism 16 is an actuator whereby a piston can move in and out of a cylinder. This actuator is an electrohydraulic cylinder in which hydraulic pressure generated by a hydraulic pump (not shown) using an electric motor 16*a* (see FIG. 2) causes a piston to move telescopically. The electric motor 16*a* is a drive source used for lifting, and the motor is built into the side portion of the cylinder of the lift drive mechanism 16.

The travel frame 12 is provided with the left and right travel units 11L and 11R, the left and right electric motors 21L and 21R, and two operating handles 17L and 17R on the left and right. The left and right operating handles 17L and 17R extend upward and to the rear from the rear of the travel frame 12, and have grips 18L and 18R at the distal ends thereof. An operator can operate the snow remover 10 using the operating handles 17L and 17R while walking along with the snow remover 10. The implement 13 and the engine 14 are attached to the vehicle body frame 15.

The left and right travel units 11L and 11R are composed of left and right crawler belts 22L and 22R, left and right drive wheels 23L and 23R disposed at the rear of the travel frame 12, and left and right rolling wheels 24L and 24R disposed at the front of the travel frame 12. The left and right drive wheels 23L and 23R function as traveling wheels. The left crawler belt 22L can be independently driven via the left drive wheel 23L by the drive power of the left electric motor 21L. The right crawler belt 22R can be independently driven via the right drive wheel 23R by the drive power of the right electric motor 21R.

The implement 13 is composed of an auger housing 25, a blower case 26 formed integrally with the back surface of the auger housing 25, an auger 27 disposed inside the auger housing 25, a blower 28 disposed inside the blower case 26, and a shooter 29 (see FIG. 1) disposed on the top of the blower case 26. The implement 13 is further provided with an auger transmission shaft 33 for transmitting the motive force of the engine 14 to the auger 27 and the blower 28. The auger transmission shaft 33 extends to the front and back of the snow remover 10, and is rotatably supported by the auger housing 25 and the blower case 26. A scraper 35 for scraping the snow surface, and left and right skids 36L and 36R that slide on the snow surface or road surface, are provided to the bottom rear end of the auger housing 25.

The blower case 26 is attached to the front-end portion of the vehicle body frame 15 so as to be able to roll (left/right rotation; swaying). An auger housing 25 integrated with the blower case 26 is also attached to the vehicle body frame 15 so as to be able to roll. As is clear from the above description, the auger housing 25 and the blower case 26 can lift, lower, and roll in relation to the travel frame 12.

The machine body 19 is provided with a rolling drive mechanism 38 for causing the auger housing 25 and the blower case 26 to roll in relation to the travel frame 12. The rolling drive mechanism 38 is an actuator that allows a piston to move in and out of a cylinder. This actuator is a type of electrohydraulic cylinder for causing a piston to move telescopically by using hydraulic pressure generated from a hydraulic piston (not shown) in an electric motor 38*a* (see FIG. 2). The electric motor 38*a* is a drive source used for rolling, and the motor is built into the side portion of the cylinder of the rolling drive mechanism 38.

As shown in FIG. 1, the engine 14 is a snow removal drive source for driving the implement 13 via an electromagnetic clutch 31 and a transmission mechanism 32. The transmission mechanism 32 is a belt-type transmission mechanism in which motive force is transmitted by a belt to the auger transmission shaft 33 from the electromagnetic clutch 31 attached to a crankshaft 14*a* of the engine 14. The motive force of the engine 14 is transferred to the auger 27 and the blower 28 through the crankshaft 14*a*, the electromagnetic clutch 31, the transmission mechanism 32, and the auger transmission shaft 33. Snow gathered by the auger 27 can be thrown clear by the blower 28 via the shooter 29.

In the snow remover 10 as shown in FIG. 1, an operating unit 40, a control unit 61, and a battery 62 are mounted between the left and right operating handles 17L and 17R. The operating unit 40 will be described hereinafter.

Figure 3:
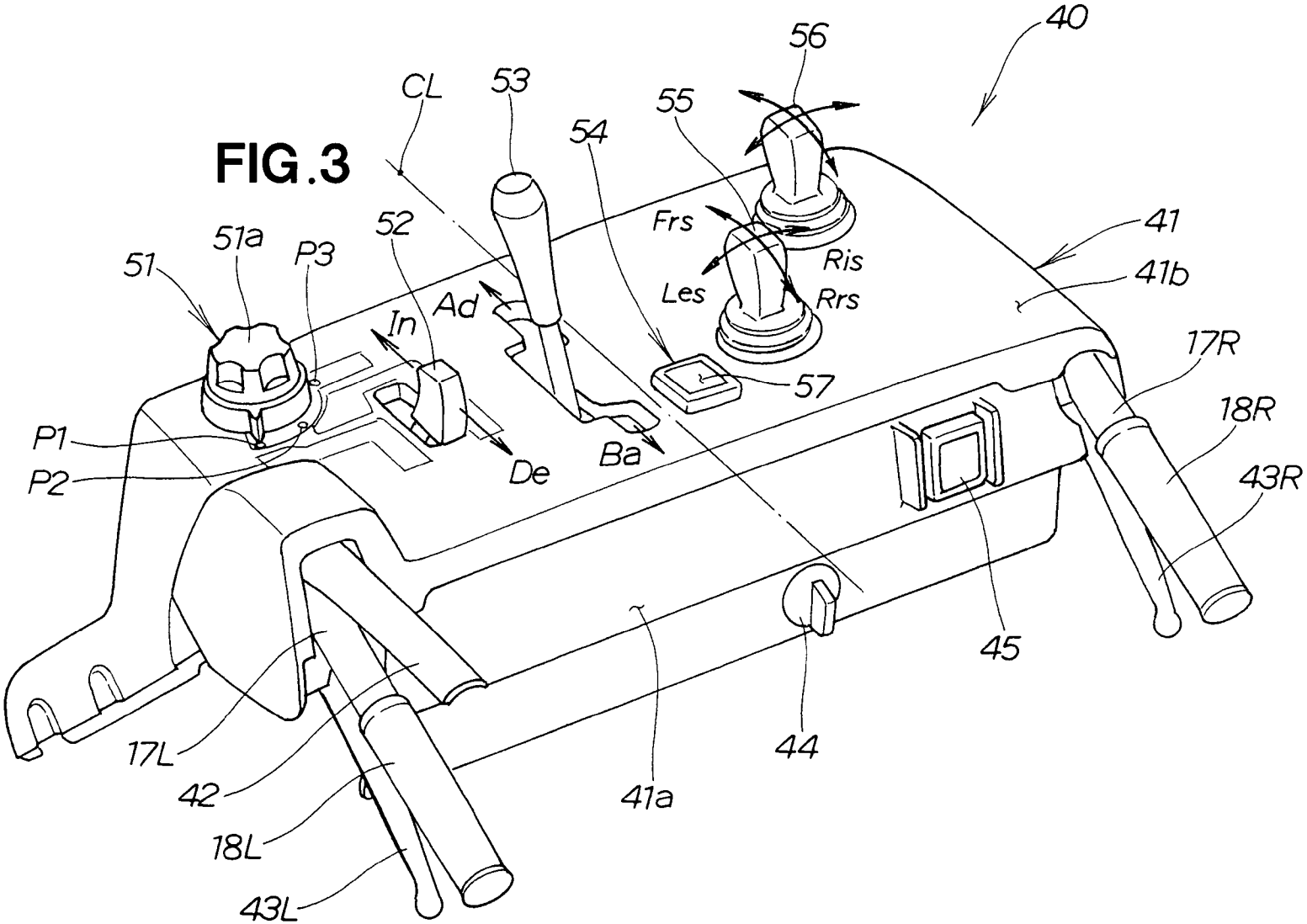
FIG. 3 is a perspective view of the operating unit shown in FIG. 1.

As shown in FIG. 3, the operating unit 40 is composed of an operating box 41, a travel preparation lever 42, a left-turn lever 43L, and a right-turn lever 43R. The operating box 41 spans the length between the left and right operating handles 17L and 17R. The travel preparation lever 42 and the left-turn lever 43L are attached near the left grip 18L to the left operating handle 17L. The right-turn lever 43R is attached near the right grip 18R to the right operating handle 17R.

The travel preparation lever 42 acts on a switch 42*a* (see FIG. 2) and is a member used to prepare for travel. The switch 42*a* is off when in the free state shown in the drawing, and is pressed into the ON state only when swung to the side of the grip 18L after the travel preparation lever 42 is grasped in the operator's left hand.

The left- and right-turn levers 43L and 43R are steering members that are operated by the hands that grip the left and right grips 18L and 18R, respectively, and are operating members that act on the corresponding turn switches 43La and 43Ra (see FIG. 2).

The left-turn switch 43La is off when in the free state shown in FIG. 3, and is pressed into the ON state only when swung to the side of the grip 18L after the left-turn lever 43L is grasped in the left hand of the operator. In other words, the left-turn switch 43La is ON when the left-turn lever 43L is turned, and is OFF when turning of the left-turn lever 43L is stopped.

The right-turn switch 43Ra is operated in the same manner. Specifically, the right-turn switch 43Ra is ON when the right-turn lever 43R is turned, and is OFF when turning of the right-turn lever 43R is stopped.

It can thereby be detected by the turn switches 43La and 43Ra whether the left- and right-turn levers 43L and 43R are being grasped.

The operating box 41 and the operating members disposed in the operating box 41 will next be described with reference to FIG. 2.

In the operating box 41 as shown in FIG. 3, a main switch 44 and an auger switch 45 are provided to the back face 41*a* (the side that faces the operator). The main switch 44 is a manually operated power switch whereby the engine 14 can be started by turning a knob to the ON position. The auger switch 45, also referred to as the "clutch-operating switch 45" or the "work drive instruction unit 45," is a manually operated switch for switching the electromagnetic clutch 31 on and off. The switch may be composed of a push-button switch, for example.

The operating box 41 is furthermore provided with a mode switch 51, a throttle lever 52, a directional speed lever 53, a reset switch 54, an auger housing alignment lever 55, and a shooter-operating lever 56 arranged in this sequence from the left side to the right side on the upper surface 41*b* thereof. More specifically, the directional speed lever 53 is disposed on the left next to the vehicle width center CL, and the reset switch 54 is disposed on the right next to the vehicle width center CL in the upper surface 41*b* of the operating box 41.

The mode switch 51 is a manually operated switch for switching the travel control mode controlled by the control unit 61 (see FIG. 2). The switch may be composed of a rotary switch, for example. A switch to a first control position P1, a second control position P2, and third control position P3 can be made by turning a knob 51*a* in the counterclockwise direction in the drawing. The mode switch 51 generates a switch signal in correspondence to the positions P1, P2, and P3 switched to by the knob 51*a*.

The first control position P1 is a switch position in which a switch signal indicating "first control mode" is issued to the control unit 61. The second control position P2 is a switch position in which a switch signal indicating "second control mode" is issued to the control unit 61. The third control position P3 is a switch position in which a switch signal indicating "third control mode" is issued to the control unit 61.

The first control mode is a mode wherein the travel speed of the travel units 11L and 11R is controlled according to the manual operation of the operator. This mode may also be referred to as "manual mode." For example, the operator may operate the snow remover while monitoring the rotational speed of the engine 14.

The second control mode is a mode wherein the travel speed of the travel units 11L and 11R is controlled so as to be gradually reduced according to the amount of increase in the travel of the throttle valve 71. This mode may also be referred to as "power mode."

The third control mode is a mode whereby the travel speed of the travel units 11L and 11R is controlled so as to be reduced more significantly than in the second control mode according to the amount of increase in the travel of the throttle valve 71. This mode may also be referred to as "auto mode (automatic mode)."

The second and third control modes may control the travel speed of the travel units 11L and 11R in accordance with the rotational speed of the engine 14, instead of according to the travel of the throttle valve 71.

The load control modes of the control unit 61 are thus set to three modes that include (1) a first control mode for manual operation used by an advanced operator who is sufficiently accustomed to operating the machine, (2) a semi-automatic second control mode used by an intermediate operator who has a certain level of experience operating the machine, and (3) an automatic third control mode used by a novice operator who has no experience operating the machine. By appropriately selecting these modes, a single snow remover 10 can easily be used in operating states that are optimized for novice-to-advanced operators.

The throttle lever 52 is an operating member that affects the rotation of a first control motor 72 in the electronic governor 65 (also referred to as an "electric governor 65") via the control unit 61. A potentiometer 52*a* issues a prescribed voltage signal (rotational speed variation instruction signal) to the control unit 61 according to the position of the throttle lever 52. The throttle lever 52 is an operating member that issues a rotational speed variation instruction to vary the rotational speed of the engine 14, and may therefore be also referred to as the "rotational speed variation instruction unit 52." The operator can swing or slide the throttle lever 52 forward and backward as indicated by arrows In and De. The throttle valve 71 can be opened and closed by operating the throttle lever 52 to cause a first control motor 72 to rotate. In other words, the rotational speed of the engine 14 can be adjusted by operating the throttle lever 52. Specifically, the throttle valve 71 can be opened all the way by moving the throttle lever 52 in the direction indicated by arrow In. The throttle valve 71 can be closed all the way by moving the throttle lever 52 in the direction indicated by arrow De.

Figure 4:
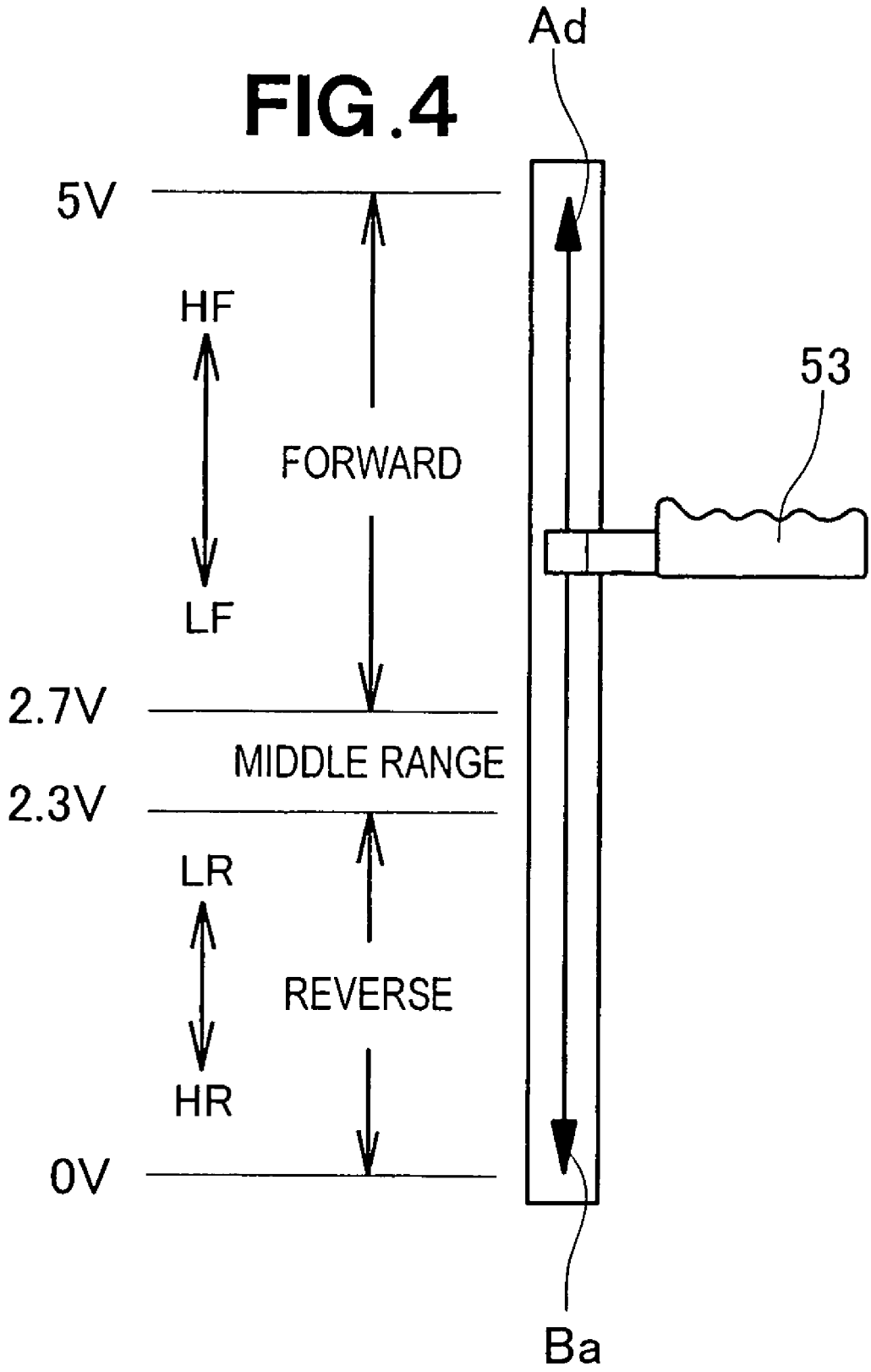
FIG. 4 is a diagram depicting the operation of the directional speed lever shown in FIG. 3.

As shown in FIGS. 3 and 4, the directional speed lever 53 is an operating member for controlling the rotation of the electric motors 21L and 21R via the control unit 61. This directional speed lever 53 is also referred to as a "forward/reverse speed adjustment lever 53," a "target speed adjustment unit 53," or a "travel drive instruction unit 53," and the operator can swing or slide the directional speed lever 53 forward and backward as indicated by arrows Ad and Ba.

When the directional speed lever 53 is moved from the "middle range" to "forward," the electric motors 21L and 21R are caused to rotate forward, and the travel units 11L and 11R can be moved forward. In the "forward" region, the travel speed of the travel units 11L and 11R can be controlled so that LF represents forward movement at low speed, and HF represents forward movement at high speed.

In the same manner, when the directional speed lever 53 is moved from the "middle range" to "reverse," the electric motors 21L and 21R are caused to rotate backward, and the travel units 11L and 11R can be moved in reverse. In the "reverse" region, the travel speed of the travel units 11L and 11R can be controlled so that LR represents reverse movement at low speed, and HR represents reverse movement at high speed.

Figure 5:
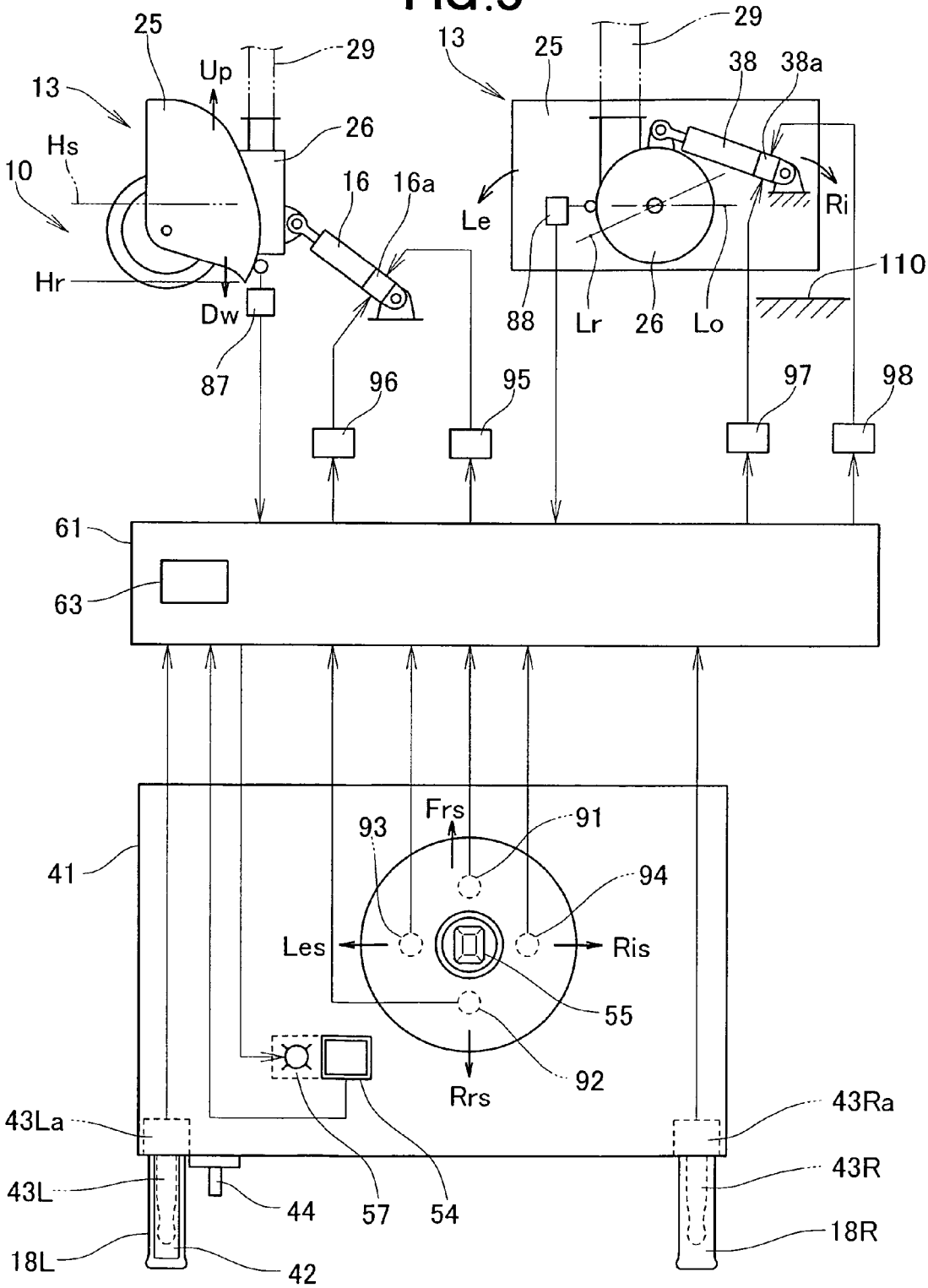
FIG. 5 is a control system diagram of the snow-removing implement shown in FIG. 2.

In this example, the potentiometer 52*a* (see FIG. 2) causes a voltage to be generated in accordance with the position so that the maximum speed of reverse movement occurs at 0 V (volts), the maximum speed of forward movement occurs at 5 V, and the middle range of speeds occurs at 2.3 V to 2.7 V, as indicated on the left side of FIG. 5. Forward or reverse movement and speed control between high and low speed can thus both be set by a single directional speed lever 53.

As shown in FIG. 3, the reset switch 54 is a manual switch for restoring the alignment (position) of the auger housing 25 to a preset origin point (reference position). This reset switch 54 is also referred to as a "switch 54 for automatically returning the auger to its original position," and is composed of a push-button switch provided with a display lamp 57, for example.

The auger housing alignment lever 55 is an operating member that can swing in four directions and is used for changing the alignment of the auger housing 25.

The shooter-operating lever 56 is an operating member capable of swinging in four directions in order to change the orientation of the shooter 29 (see FIG. 1).

To summarize the description given above, the snow remover 10 is provided with travel units 11L and 11R disposed on the left and right of the machine body 19, an implement 13 disposed at the front of the machine body 19, left- and right-turn levers 43L and 43R, and a lift drive mechanism 16 and rolling drive mechanism 38 disposed in the machine body 19.

The left-turn lever 43L is a steering member for switching the left and right travel units 11L and 11R so that a left turn is made. The right-turn lever 43R is a steering member for switching the left and right travel units 11L and 11R so that a right turn is made. The lift drive mechanism 16 lifts and lowers the implement 13 in relation to the machine body 19. The rolling drive mechanism 38 causes the implement 13 to roll in relation to the machine body 19.

The control system of the snow remover 10 will next be described with reference to FIG. 2. The control system of the snow remover 10 is centralized in the control unit 61. The control unit 61 includes memory 63 and is configured so as to appropriately read various types of information (including the control routine described hereinafter) stored in the memory 63. This control unit 61 controls the electronic governor 65, correlates the operation of the electronic governor 65 with the operation of the electric motors 21L and 21R, and controls the travel speed.

The engine 14 will first be described. The air intake system of the engine 14 is configured so that the travel of the choke valve 73 and the travel of the throttle valve 71 are adjusted by the electronic governor 65. In other words, the first control motor 72 of the electronic governor 65 automatically adjusts the travel of the throttle valve 71 on the basis of the signal of the control unit 61. The second control motor 74 of the electronic governor 65 automatically adjusts the travel of the choke valve 73 on the basis of the signal of the control unit 61.

The electronic governor 65 has an automatic choke (also referred to as auto-choke) function for automatically opening and closing the choke valve 73 according to the temperature state of the engine 14. The engine 14 can be more appropriately and easily warmed up by automatically opening and closing the choke valve 73 according to the temperature state of the engine 14 when the engine 14 is started.

The engine 14 is provided with a throttle position sensor 75, a choke position sensor 76, an engine rotation sensor 77, and a generator 81. The throttle position sensor 75 detects the travel of the throttle valve 71 and issues a detection signal to the control unit 61. The choke position sensor 76 detects the travel of the choke valve 73 and issues a detection signal to the control unit 61. The engine rotation sensor 77 detects the speed of rotation (rotational speed) of the engine 14 and issues a detection signal to the control unit 61. The generator 81 is rotated by the engine 14 and feeds the resultant electrical power to a battery 62, the left and right electric motors 21L and 21R, and other electrical components.

By grasping the travel preparation lever 42 and turning the auger switch 45 ON, the electromagnetic clutch 31 can be connected (ON), and the auger 27 and blower 28 can be rotated by the motive force of the engine 14. The electromagnetic clutch 31 can be disengaged (OFF) by freeing the travel preparation lever 42 or turning off the auger switch 45.

The system that includes the travel units 11L and 11R will next be described. The snow remover 10 is provided with left and right electromagnetic brakes 82L and 82R for restricting the movement of the travel units 11L and 11R. The left and right electromagnetic brakes 82L and 82R correspond to a parking brake in a normal automobile, and are configured so as to restrict the movement of the motor shafts of the left and right electric motors 21L and 21R, for example. When the machine is parked, the electromagnetic brakes 82L and 82R are placed in a braking state (ON state) by the control action of the control unit 61.

The control unit 61 releases the electromagnetic brakes 82L and 82R when all of the conditions are satisfied from among a first condition wherein the main switch 44 is in the ON position, a second condition wherein the travel preparation lever 42 is grasped, and a third condition wherein the directional speed lever 53 is in the forward movement or reverse movement position. The control unit 61 then causes the left and right electric motors 21L and 21R to rotate via left and right motor drivers 84L and 84R on the basis of information as to the position of the directional speed lever 53 obtained from a potentiometer 53*a*. The control unit 61 also executes feedback control so that the speed of rotation (rotational speed) of the electric motors 21L and 21R detected by motor rotation sensors 83L and 83R conforms to a prescribed value. As a result, the left and right travel units 11L and 11R turn at a prescribed speed in a prescribed direction and allow the machine to travel.

The motor drivers 84L and 84R have regenerative brake circuits 85L and 85R, and short-circuit brake circuits 86L and 86R. The short-circuit brake circuits 86L and 86R are a type of braking means.

When the left-turn lever 43L is being grasped and the left-turn switch 43La is turned ON, the control unit 61 actuates the left regenerative brake circuit 85L on the basis of the switch-ON signal thus generated. As a result, the speed of the left electric motor 21L decreases. The snow remover 10 can therefore be turned left only when the left-turn lever 43L is grasped.

When the right-turn lever 43R is being grasped and the right-turn switch 43Ra is turned ON, the control unit 61 actuates the right regenerative brake circuit 85R on the basis of the switch-ON signal thus generated. As a result, the speed of the right electric motor 21R decreases. The snow remover 10 can therefore be turned right only when the right-turn lever 43R is grasped.

The travel units 11L and 11R can be stopped and the electromagnetic brakes 82L and 82R returned to the braking state by performing any of the operations that include (i) returning the main switch 44 to the OFF position, (ii) releasing the travel preparation lever 42, or (iii) returning the directional speed lever 53 to the middle position.

The control system for the auger housing 25 will next be described. FIG. 5 is a more detailed view of the control system of the auger housing 25 shown in FIG. 2.

As shown in FIG. 5, the operating box 41 is provided with four switches 91 through 94 used for to align the auger housing and disposed on the periphery of the auger housing alignment lever 55. These four switches include a lowering switch 91 disposed in front of the auger housing alignment lever 55, an elevating switch 92 disposed to the rear thereof, a left-rolling switch 93 disposed to the left thereof, and a right-rolling switch 94 disposed to the right thereof. For example, when snow is removed by the snow remover 10, the operator operates the auger housing alignment lever 55 so that the alignment of the auger housing 25 conforms to the height of the snow to be removed.

When the auger housing alignment lever 55 is swung forward Frs, the lowering switch 91 is turned ON. The control unit 61, having received the ON signal, turns ON a lowering relay 95, whereby the electric motor 16*a* is powered and caused to rotate forward. As a result, the lift drive mechanism 16 lowers the implement 13 as indicated by arrow Dw.

When the auger housing alignment lever 55 is swung in reverse Rrs, the elevating switch 92 is turned ON. The control unit 61, having received the ON signal, turns ON an elevating relay 96, whereby the electric motor 16*a* is powered and caused to rotate backward. As a result, the lift drive mechanism 16 raises the implement 13 as indicated by arrow Up.

When the auger housing alignment lever 55 is swung to the left Les, the left-rolling switch 93 is turned ON. The control unit 61, having received the ON signal, turns ON a left-rolling relay 97, whereby the electric motor 38*a* is powered and caused to rotate forward. As a result, the rolling drive mechanism 38 causes the implement 13 to roll to the left as indicated by arrow Le.

When the auger housing alignment lever 55 is swung to the right Ris, the right-rolling switch 94 is turned ON. The control unit 61, having received the ON signal, turns ON a right-rolling relay 98, whereby the electric motor 38*a* is powered and caused to rotate backward. As a result, the rolling drive mechanism 38 causes the implement 13 to roll to the right as indicated by arrow Ri.

When the auger housing alignment lever 55 is thus swung forward Frs or backward Rrs, the piston of the lift drive mechanism 16 extends or retracts. As a result, the auger housing 25 and the blower case 26 are lifted or lowered. When the auger housing alignment lever 55 is swung to the left Les or right Ris, the piston of the rolling drive mechanism 38 is extended or retracted. As a result, the auger housing 25 and the blower case 26 perform a rolling movement.

The snow remover 10 is provided with a height position sensor 87 and a rolling position sensor 88.

The height position sensor 87 is a vertical movement detection unit for detecting the lift position Hr (height position Hr) of the auger housing 25 in relation to the machine body 19 and issuing a detection signal to the control unit 61. The sensor may, for example, be composed of a potentiometer. The detection signal of the height position sensor 87 is a voltage signal (height position detection signal) that corresponds to the height position Hr of the auger housing 25.

The rolling position sensor 88 is a left-right tilt detection unit for detecting the rolling position (position Lr of tilt to the left and right) of the auger housing 25 in relation to the machine body 19, and issuing a detection signal to the control unit 61. The sensor may, for example, be composed of a potentiometer. The detection signal of the rolling position sensor 88 is a voltage signal (tilt position detection signal) that corresponds to the tilt position Lr.

The term "height position Hr" herein refers to the actual height position of the implement 13. The actual height position Hr will be referred to hereinafter as the "actual height position Hr". More specifically, the actual height position Hr is the height of the lower end of the scraper 35 (see FIG. 1) when the auger housing 25 is in a horizontal state.

The term "tilt position Lr" refers to the actual tilt position of the implement 13. The actual tilt position Lr will be referred to hereinafter as the "actual tilt position Lr." More specifically, the actual tilt position Lr is the amount of tilt of the lower end of the scraper 35 (see FIG. 1) when the auger housing 25 is rolled (tilted to the left or right) from a horizontal state in the transverse direction in relation to the machine body 19.

The term "reference upper-limit position Hs" is used herein to designate the height position of the implement 13 at which the auger housing 25 or scraper 35 does not touch the snow surface when the snow remover 10 makes a turn while removing snow. This reference upper-limit position Hs is stored in advance in the memory 63 of the control unit 61.

The reference upper-limit position Hs can be set according to the following two methods. In the first method, the reference upper-limit position Hs is set by storing a value for the reference upper-limit position Hs in the memory 63 before the snow remover 10 is shipped from the factory or warehouse. In the second method, the reference upper-limit position Hs stored in advance in the memory 63 is rewritten as a new reference upper-limit position Hs according to the snow removal work scene.

Figure 6:
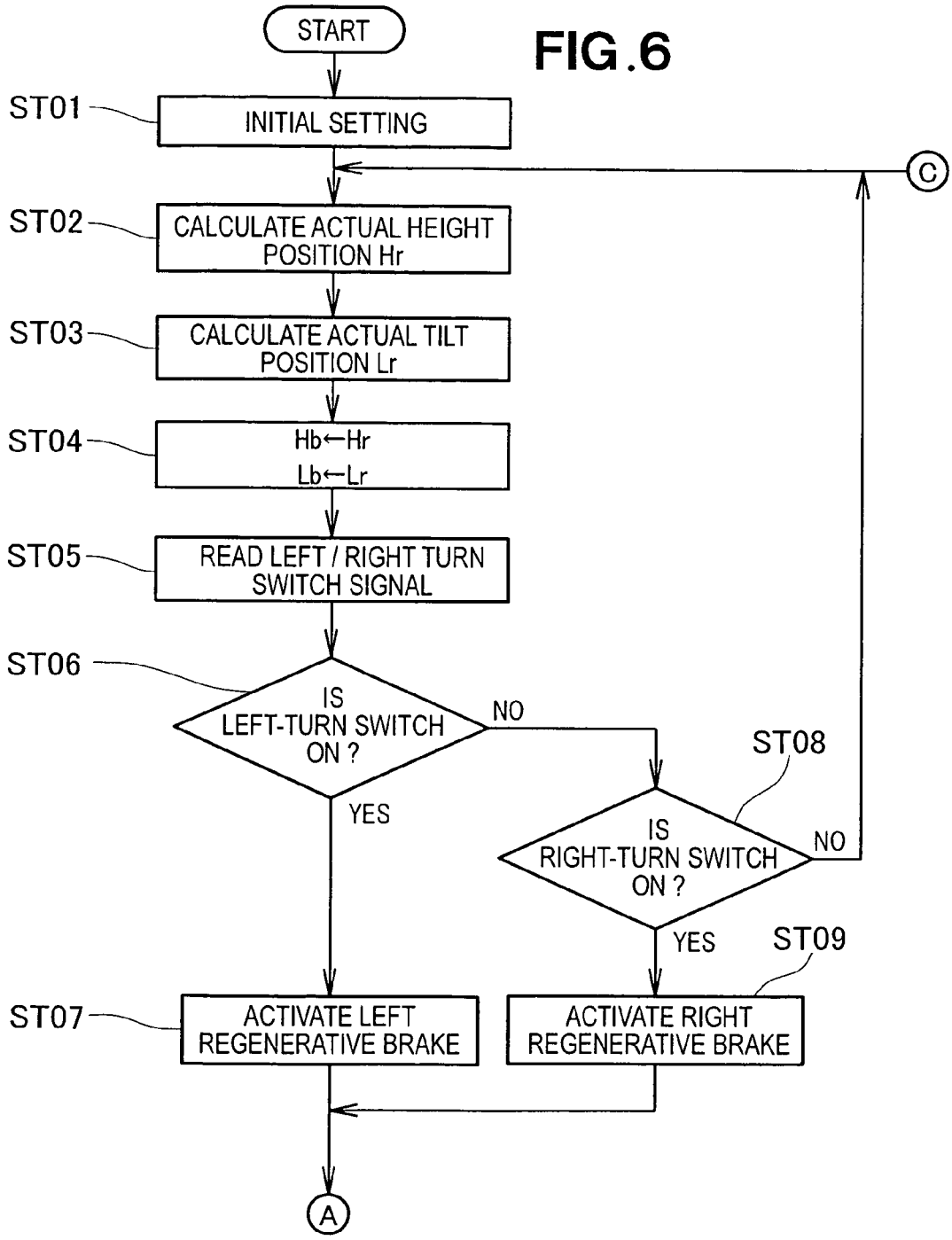
FIG. 6 is a control routine chart showing the first stage in the control routine of the control unit shown in FIG. 5.
Figure 7:
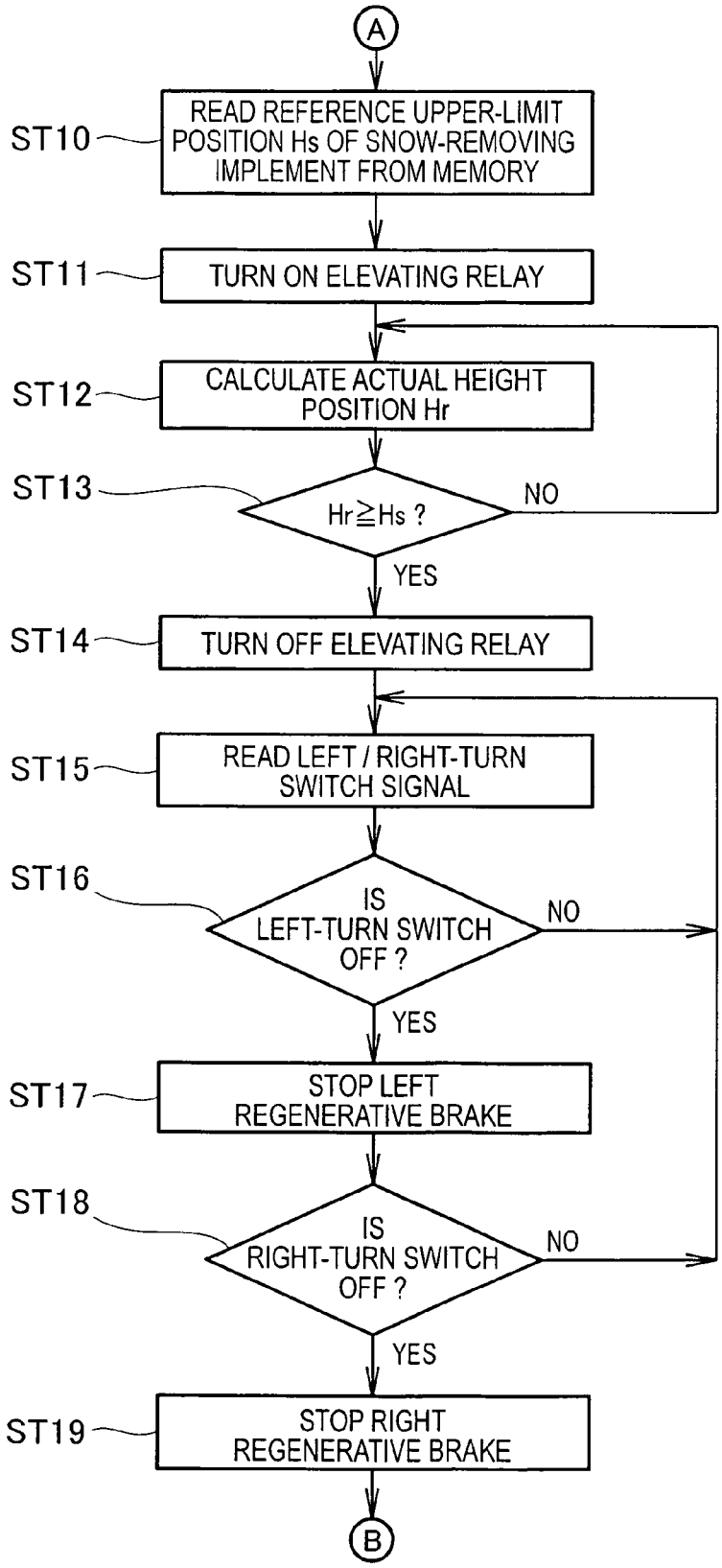
FIG. 7 is a control routine chart showing the middle stage in the control routine of the control unit shown in FIG. 5.
Figure 8:
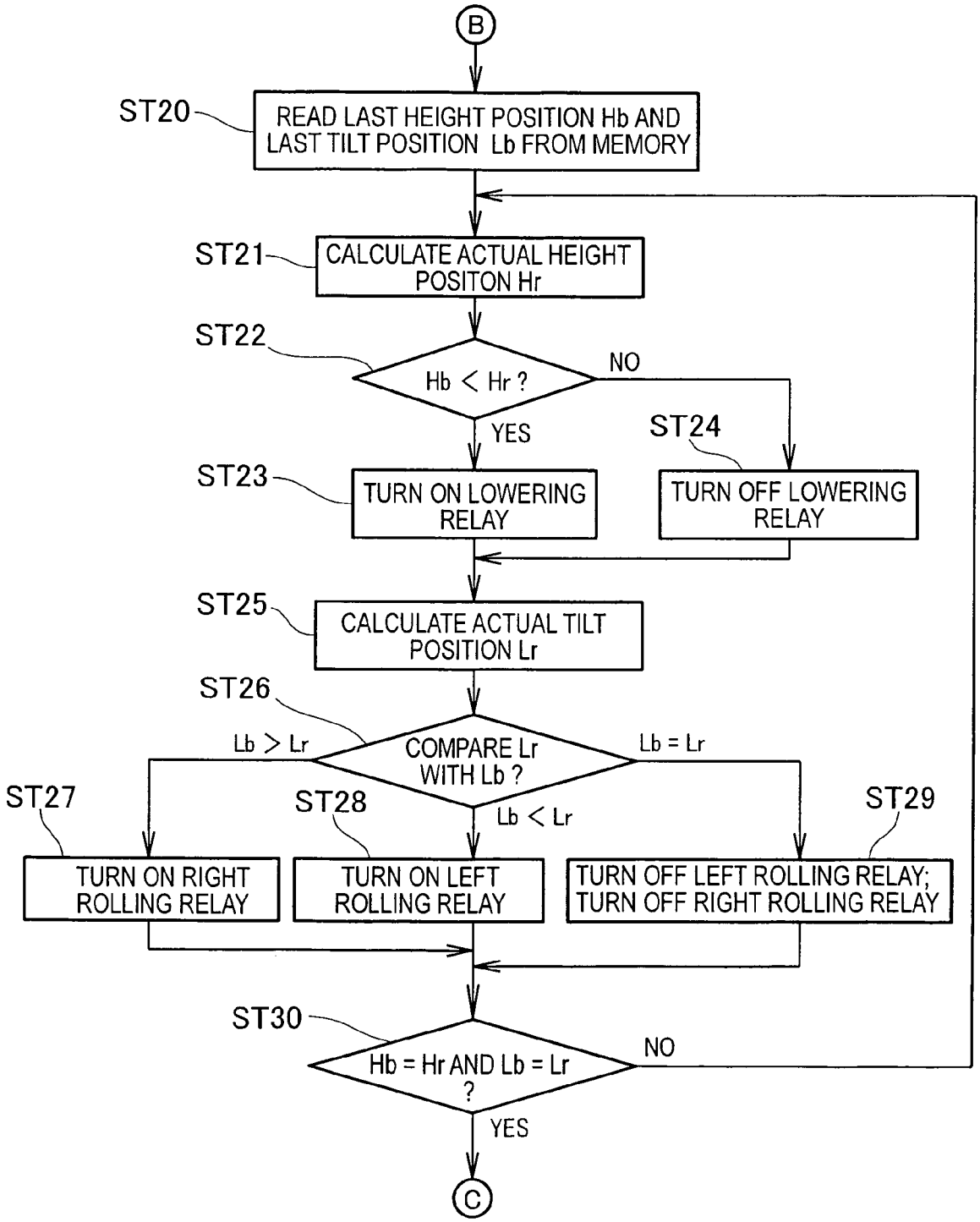
FIG. 8 is a control routine chart showing the latter stage in the control routine of the control unit shown in FIG. 5.
Figure 9:
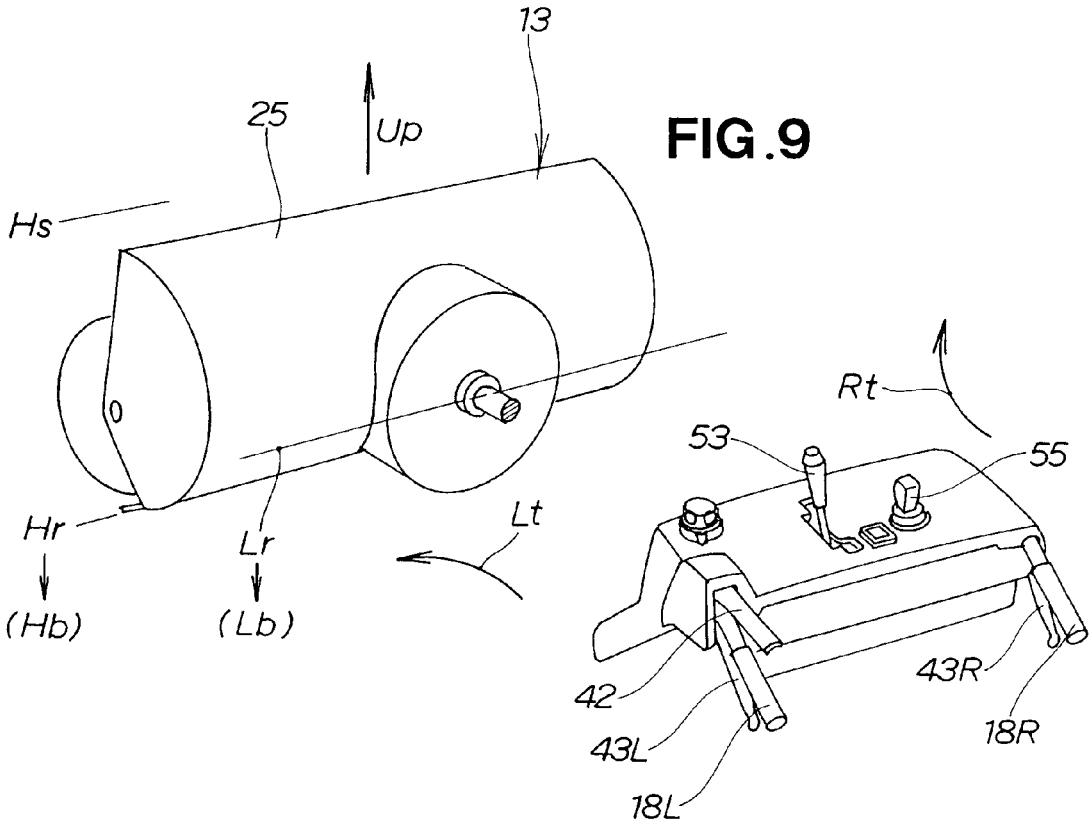
FIG. 9 is a view of an operation example in which the snow-removing implement shown in FIG. 5 is raised.

A control routine used when the control unit 61 is a microcomputer will next be described based on FIGS. 6 through 8. The control routine initiates control when the main switch 44 is turned ON, for example, and ends control when the main switch 44 is turned OFF. The control routine will be described for a case in which a forward-traveling snow remover 10 is turned through the action of the regenerative brake circuits 85L and 85R (see FIG. 2)

The following description will be given based on FIGS. 6 through 8 with reference to FIGS. 5 and 9 through 11C.

Step (hereinafter abbreviated as ST) ST01: The last height position Hb and last tilt position Lb are set to the initial value "0" (last height position=0, last tilt position Lb=0). The values Hb=0 and Lb=0 are written into the memory 63. The term "last height position Hb" used herein refers to the height position of the implement 13 immediately before the implement 13 is raised when the snow remover 10 is in a turn. The term "last tilt position Lb" used herein refers to the tilt position of the implement 13 immediately before the implement 13 is raised when the snow remover 10 is in a turn.

ST02: The actual height position Hr of the implement 13 is calculated. The detection signal from the height position sensor 87 may be read as the actual height position Hr.

ST03: The actual tilt position Lr of the implement 13 is calculated. The detection signal from the rolling position sensor 88 may be read as the actual tilt position Lr.

ST04: The value of the last height position Hb is substituted with the actual height position Hr calculated in ST02, and is then written into the memory 63. It is assumed that the value of the last height position Hb substituted herein is the "actual height position Hr immediately prior to the raising of the implement 13." Furthermore, the value of the last tilt position Lb is substituted with the actual tilt position Lr calculated in ST03, and is then written into the memory 63. It is assumed that the value of the last tilt position Lb substituted herein is the "actual tilt position Lr immediately prior to the raising of the implement 13."

ST05: The switch signals of the left- and right-turn switches 43La and 43Ra are read.

ST06: It is determined whether the left-turn switch 43La is ON. If YES, then the process proceeds to ST07. If NO, then the process proceeds to ST08. The left-turn switch 43La is ON when the left-turn lever 43L is grasped in the operator's hand. When a YES condition is established in ST06, it is determined that the values of the last height position Hb and last tilt position Lb rewritten in ST04 are the "actual height position Hr and actual tilt position Lr immediately prior to the raising of the implement 13."

ST07: The left regenerative brake circuit 85L is operated, and the left travel unit 11L is decelerated, after which the process proceeds to ST10 in FIG. 7. As a result, the snow remover 10 is turned to the left as indicated by arrow Lt in FIG. 9.

ST08: It is determined whether the right-turn switch 43Ra is ON. If YES, then the process proceeds to ST09. If NO, then the process returns to ST02. The right-turn switch 43Ra is ON when the right-turn lever 43R is grasped in the operator's hand. When a YES condition is established in ST08, it is determined that the values of the last height position Hb and last tilt position Lb rewritten in ST04 are the "actual height position Hr and actual tilt position Lr immediately prior to the raising of the implement 13."

ST09: The right regenerative brake circuit 85R is operated, and the right travel unit 11R is decelerated, after which the process proceeds to ST10 in FIG. 8. As a result, the snow remover 10 is turned to the right as indicated by arrow Rt in FIG. 9.

ST10: The reference upper-limit position Hs of the implement 13 is read from the memory 63.

ST11: The elevating relay 96 is turned ON. As a result, the lift drive mechanism 16 raises the implement 13 as indicated by arrow Up in FIG. 9.

ST12: The actual height position Hr of the implement 13 is calculated.

ST13: It is determined whether the actual height position Hr has reached the reference upper-limit position Hs in conjunction with the raising of the implement 13. IF YES, then the process proceeds to ST14. If NO, then the process returns to ST12.

Figure 10:
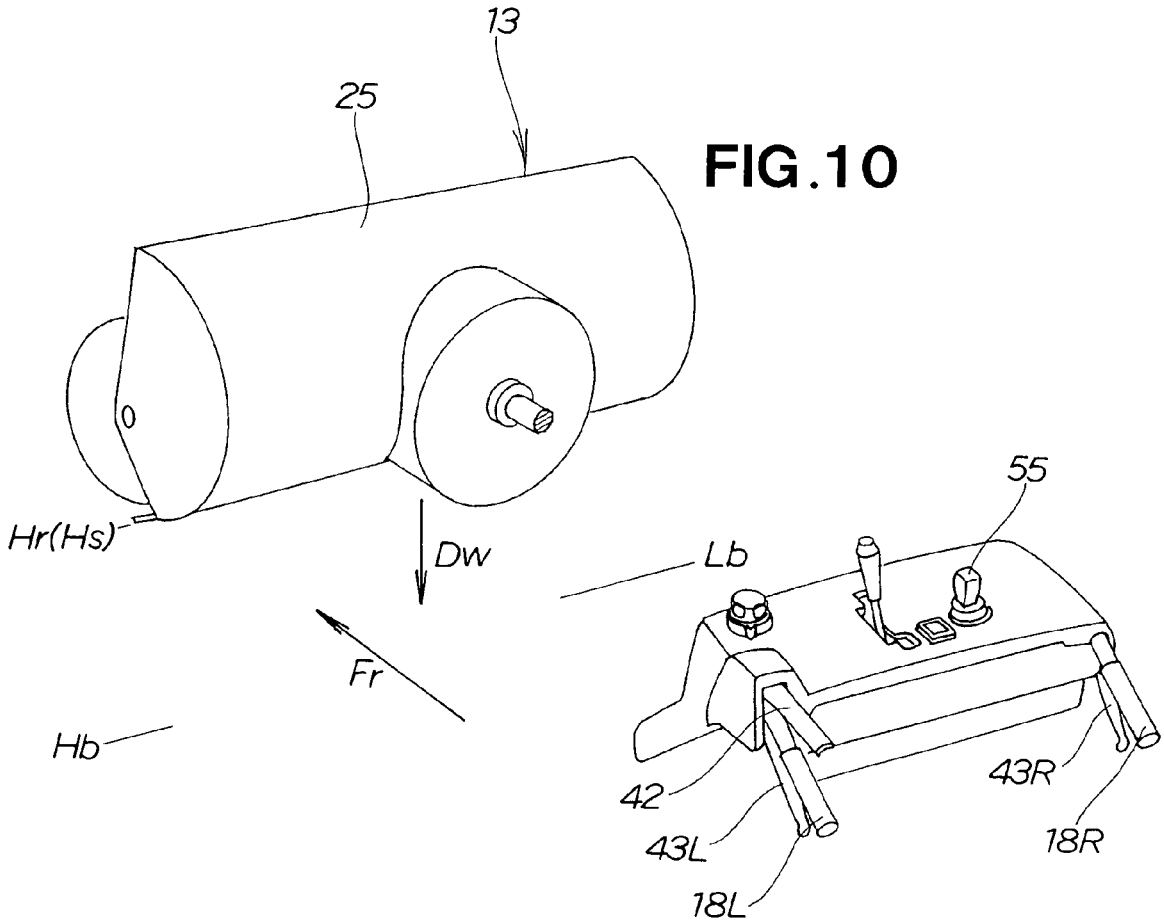
FIG. 10 is a view of an operation example in which the snow-removing implement shown in FIG. 5 is lowered.

ST14: The elevating relay 96 is turned OFF. As a result, the lift drive mechanism 16 stops raising the implement 13, as shown in FIG. 10.

ST15: The switch signals of the left- and right-turn switches 43La and 43Ra are read.

ST16: It is determined whether the left-turn switch 43La is OFF. If YES, then the process proceeds to ST17. If NO, then the process returns to ST15. The left-turn switch 43La is OFF when the operator's hand is removed from the left-turn lever 43L.

ST17: The left regenerative brake circuit 85L is stopped.

ST18: It is determined whether the right-turn switch 43Ra is OFF. If YES, then the process proceeds to ST19. If NO, then the process returns to ST15. The right-turn switch 43Ra is OFF when the operator's hand is removed from the right-turn lever 43R.

ST19: After the right regenerative brake circuit 85R is stopped, the process proceeds to ST20 in FIG. 8. As a result, since the left and right regenerative brake circuits 85L and 85R are both stopped, the snow remover 10 returns to straight forward (forward) travel, as indicated by arrow Fr in FIG. 10.

ST20: The last height position Hb and the last tilt position Lb are read from the memory 63.

ST21: The actual height position Hr of the implement 13 is calculated.

ST22: It is determined whether the actual height position Hr with respect to the last height position Hb is high (Hb<Hr). If YES, then the process proceeds to ST23. If NO, then it is determined that the actual height position Hr has lowered to the last height position Hb (Hb=Hr), and the process proceeds to ST24.

ST23: The lowering relay 95 is turned ON. As a result, the lift drive mechanism 16 lowers the implement 13 as indicated by arrow Dw in FIG. 10.

ST24: The lowering relay 95 is turned OFF. As a result, the lift drive mechanism 16 stops lowering the implement 13.

ST25: The actual tilt position Lr of the implement 13 is calculated.

ST26: The last tilt position Lb and the actual tilt position Lr are compared with each other.

Figure 11A:
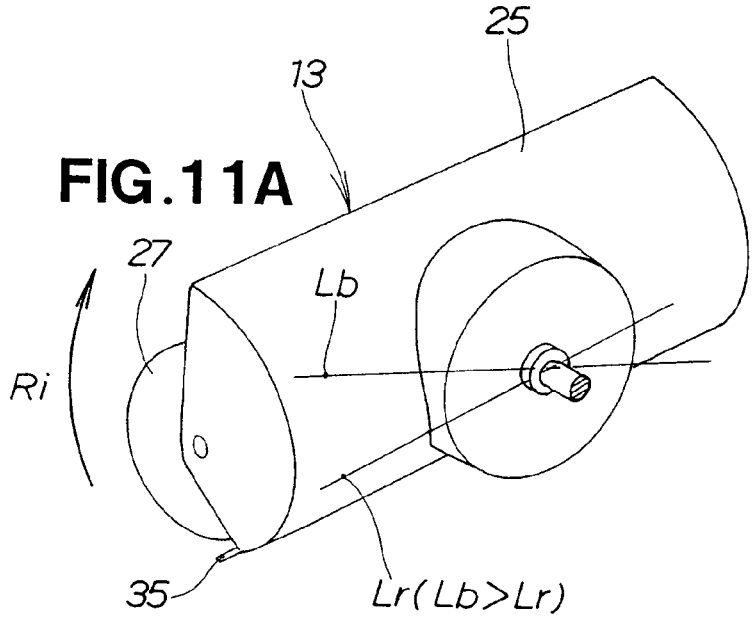
FIGS. 11A, 11B, and 11C are diagrams showing orientations of the snow-removing implement shown in FIG. 5.

As shown in FIG. 11A, the process proceeds to ST27 when it is determined that the actual tilt position Lr is tilted downward and to the left with respect to the last tilt position Lb (Lb>Lr), i.e., when it is determined that the left end of the auger housing 25 is lowered.

Figure 11B:
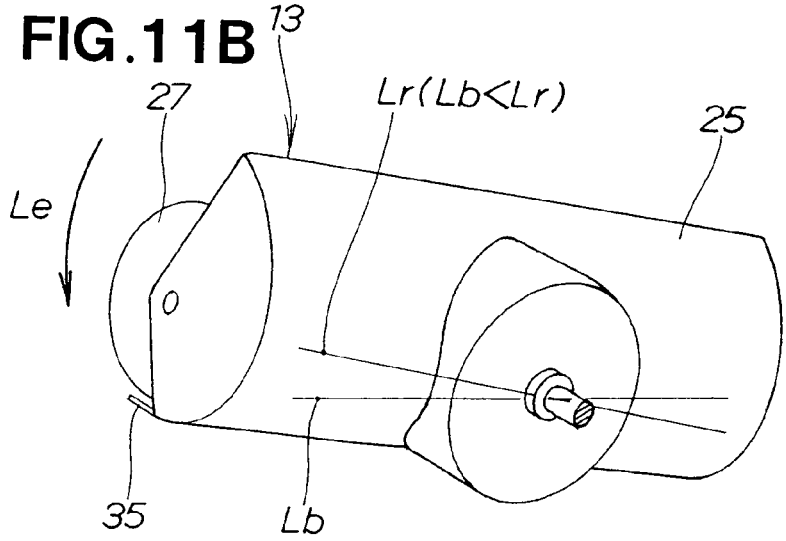

As shown in FIG. 11B, the process proceeds to ST28 when it is determined that the actual tilt position Lr is tilted downward and to the right with respect to the last tilt position Lb (Lb<Lr), i.e., when the right end of the auger housing 25 is lowered.

Figure 11C:
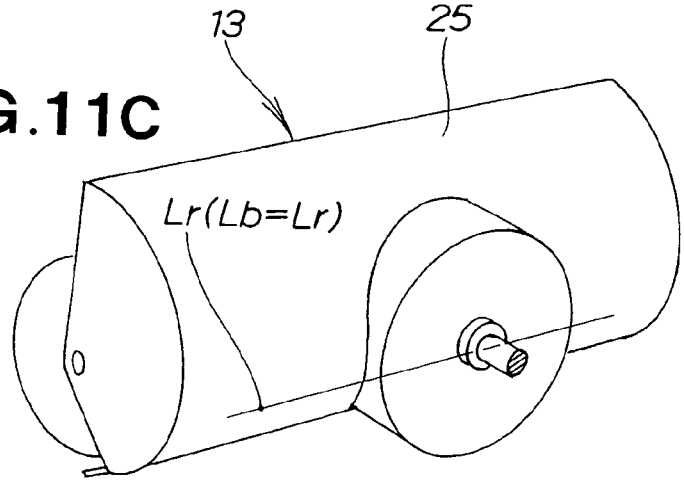

As shown in FIG. 11C, the process proceeds to ST29 when it is determined that the actual tilt position Lr matches the last tilt position Lb (Lb=Lr), i.e., when it is determined that the auger housing 25 is horizontal.

ST27: The right-rolling relay 98 is turned ON. As a result, the rolling drive mechanism 38 causes the implement 13 to roll to the right as indicated by arrow Ri in FIG. 11A.

ST28: The left rolling relay 97 is turned ON. As a result, the rolling drive mechanism 38 causes the implement 13 to roll to the left as indicated by arrow Le in FIG. 11B.

ST29: The left and right rolling relays 97 and 98 are turned OFF. As a result, the rolling drive mechanism 38 stops the rolling of the implement 13.

ST30: It is determined whether conditions are satisfied wherein the actual height position Hr matches the last height position Hb (Hb=Hr), and the actual tilt position Lr matches the last tilt position Lb (Lb=Lr). If YES, then the process returns to ST02. If NO, then the process returns to ST21.

Steps ST21 through ST30 are thus repeated until the following conditions are satisfied: "Hb=Hr" and "Lb=Lr." The implement 13 can thereby be returned to the state (original alignment) of the last tilt position Lb in the last height position Hb.

An example was described in this embodiment in which the routine for lowering the implement 13 according to ST21 through ST24 and the routine for tilting the implement 13 according to ST25 through ST29 were executed separately. However, the routine of ST21 through ST24 and the routine of ST25 through ST29 may be configured as parallel routines that are executed simultaneously.

The following is a summary of the description given above.

The control unit 61 issues a lift drive instruction (ST11) to the lift drive mechanism 16 so as to lift the implement 13 when it is determined (YES in ST06 or YES in ST08) that a steering condition is satisfied wherein the left or right-turn lever 43L or 43R (turn operating members 43L and 43R) is turned. The control unit 61 then issues (ST23) a lowering drive instruction to the lift drive mechanism 16 so as to lower the implement 13 when it is determined (YES in both ST16 and ST18) that the aforementioned steering condition is not satisfied.

Therefore, when the left or right-turn lever 43L or 43R is turned, the implement 13 can be raised by the lift drive mechanism 16 in conjunction with the operation of the left or right-turn lever. In other words, the implement 13 can be automatically raised to a relatively high position when the snow remover 10 is in a turn. Accordingly, since accumulated snow does not interfere with turning, the ability to turn the snow remover 10 during snow removal can be enhanced.

When the turning operation of the turn levers 43L and 43R is subsequently stopped, the implement 13 can be lowered by the lift drive mechanism 16 in conjunction with the completion of the turn operation. In other words, the implement 13 can be automatically lowered to a low position when the snow remover 10 has completed the turn. Snow removal can therefore be rapidly resumed.

The implement 13 can thus be automatically raised and lowered in accordance with the operation of the turn levers 43L and 43R. There is no need for the implement 13 to be raised and lowered manually each time the operator causes the snow remover 10 to revert to a forward movement. The burden on the operator can therefore be alleviated even further.

The control unit 61 stores in advance (ST04) the height position Hb of the implement 13 at the time at which it is determined (YES in ST06 or YES in ST08) that the aforementioned steering condition is satisfied. The control unit 61 then issues (ST21 through ST24) a lowering drive instruction so as to return the height position Hr of the implement 13 to the original stored height position Hb when it is determined (YES in both ST16 and ST18) that the aforementioned steering condition is no longer satisfied.

The height of accumulated snow at the location being cleared is often substantially constant. Therefore, a configuration is adopted in which the height position Hb of the implement 13 is stored during turning, and the implement 13 is automatically returned to the stored height position Hb when the turn is completed. The implement 13 can thereby be automatically returned to the snow removal position when a turn is completed. There is therefore no need to manually raise and lower the implement 13. The burden on the operator can therefore be alleviated even further.

The control unit 61 also stores in advance (ST04) the rolling position Lb of the implement 13 unit at the time at which it is determined (YES in ST06 or YES in ST08) that the aforementioned steering condition is satisfied. The control unit 61 then issues (ST25 through ST29) an adjustment drive instruction to the rolling drive mechanism 38 so as to match the tilt Lr of the implement 13 to the stored original rolling position Lb when it is determined (YES in both ST16 and ST18) that the aforementioned steering condition is no longer satisfied.

The rolling position Lb is thus stored during a turn, and the implement 13 is automatically returned to the stored rolling position Lb when the turn is completed. In other words, the left-right tilt of the implement 13 can be returned to the original state. The original tilt state can be considered to generally coincide with the snow surface at the location being cleared. Therefore, the operator can re-adjust the tilt position of the implement 13 by merely adjusting the original tilt position to fit a new area where snow is removed after the turn has been made. In other words, a small adjustment is sufficient to adapt to the snow surface. Accordingly, snow can be removed more adequately, and the snow remover 10 can be made even easier to operate.

A modified example of the snow remover 10 will next be described based on FIG. 12 and FIGS. 13A through 13C. In the snow remover 10 of the modified example, the content of the control routine in FIG. 8 is changed to that of the control routine of the modified example shown in FIG. 12. Other aspects of the configuration are the same as the configuration and operation of the abovementioned embodiment, and description thereof is omitted.

Figure 12:
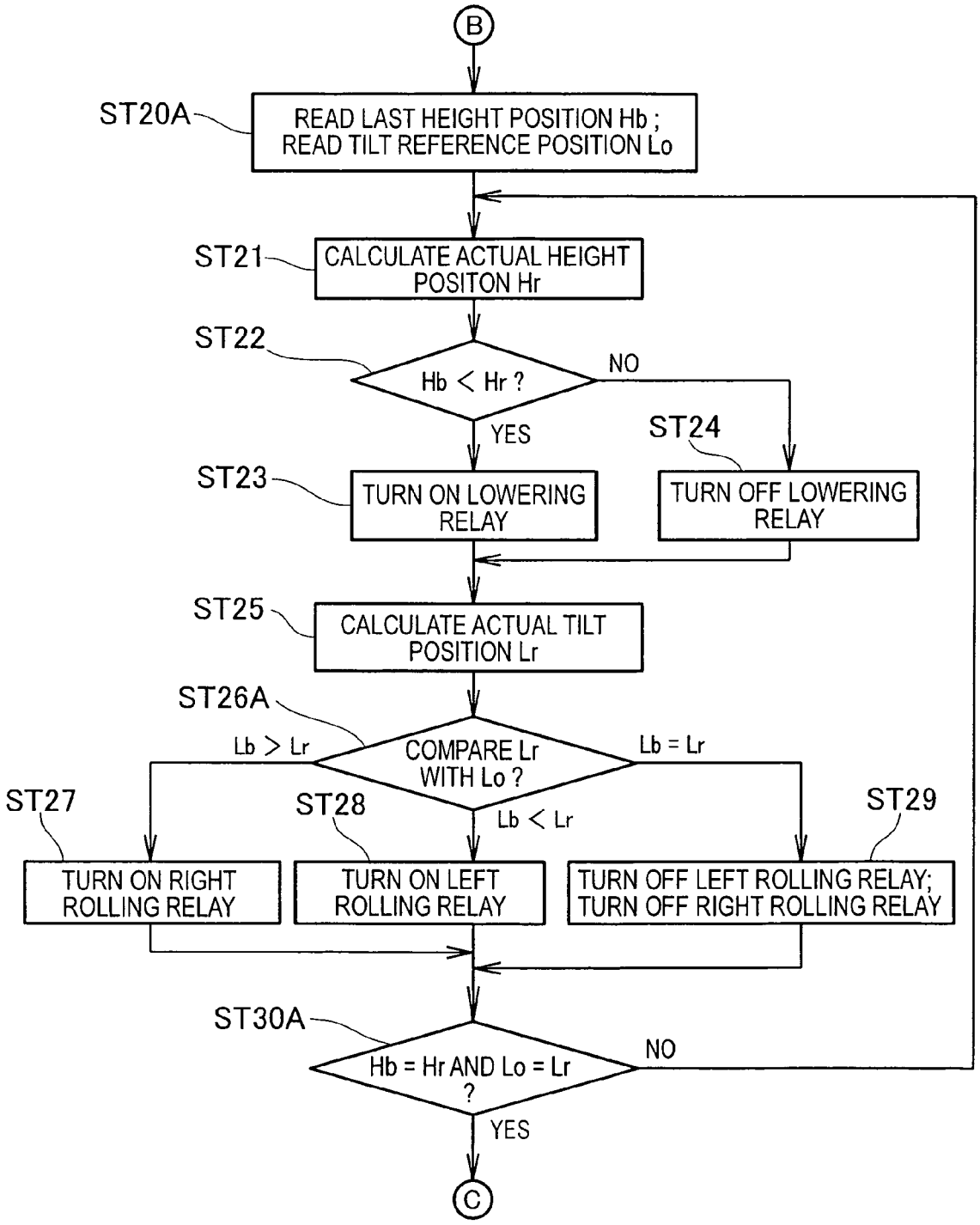
FIG. 12 is a view of a modified example of the control routine chart shown in FIG. 8.

Essential features of the control routine according to the modified example shown in FIG. 12 are as follows. In the control routine shown in FIG. 8, ST20 is changed to ST20A, ST26 is changed to ST26A, and ST30 is changed to ST30A. In other words, the term "last tilt position Lb" was used in ST20, ST26, and ST30 shown in FIG. 8. In contrast, in ST20A, ST26A, and ST30A shown in FIG. 12, the term "tilt reference position Lo" is used instead of the term "last tilt position Lb." A prescribed tilt reference position Lo (rolling reference position Lo) is stored in advance in the memory 63 of the control unit 61 shown in FIG. 5.

The term "tilt reference position Lo" used herein refers to a position (tilt position) in the transverse direction that is used as a reference when rolling of the implement 13 is started. This tilt reference position Lo is set to a value of "0," for example (Lo=0). When the tilt reference position Lo is "0," the scraper 35 provided to the auger housing 25 is in a horizontal state, as shown in FIG. 13C. In other words, the implement 13 is not tilted at all to the left or right.

The tilt reference position Lo may be set according to the following two methods. In the first method, the tilt reference position Lo is set by storing a value for the tilt reference position Lo in the memory 63 before the snow remover 10 is shipped from the factory or warehouse. In the second method, the tilt reference position Lo stored in advance in the memory 63 is rewritten as a new tilt reference position Lo according to the snow removal work scene.

The control routine according to the modified example will be described hereinafter based on FIG. 12 with reference to FIG. 5 and FIGS. 13A through 13C.

ST20A: The last height position Hb and the tilt reference position Lo (rolling reference position Lo) are read from the memory 63.

ST21: The actual height position Hr of the implement 13 is calculated.

ST22: It is determined whether Hb<Hr. If YES, then the process proceeds to ST23. If NO, then the process proceeds to ST24.

ST23: The lowering relay 95 is turned ON.

ST24: The lowering relay 95 is turned OFF.

ST25: The actual tilt position Lr of the implement 13 is calculated.

ST26A: The tilt reference position Lo and the actual tilt position Lr are compared with each other.

Figure 13A:
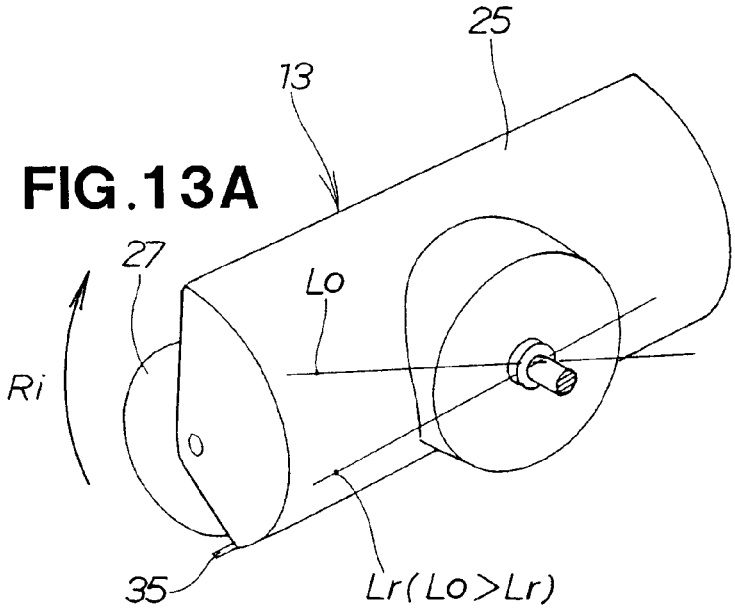
FIGS. 13A, 13B, and 13C are diagrams showing orientations of the snow-removing implement according to the modified example.

As shown in FIG. 13A, the process proceeds to ST27 when it is determined that the actual tilt position Lr is tilted downward and to the left with respect to the tilt reference position Lo (Lo>Lr), i.e., when it is determined that the left end of the auger housing 25 is lowered.

Figure 13B:
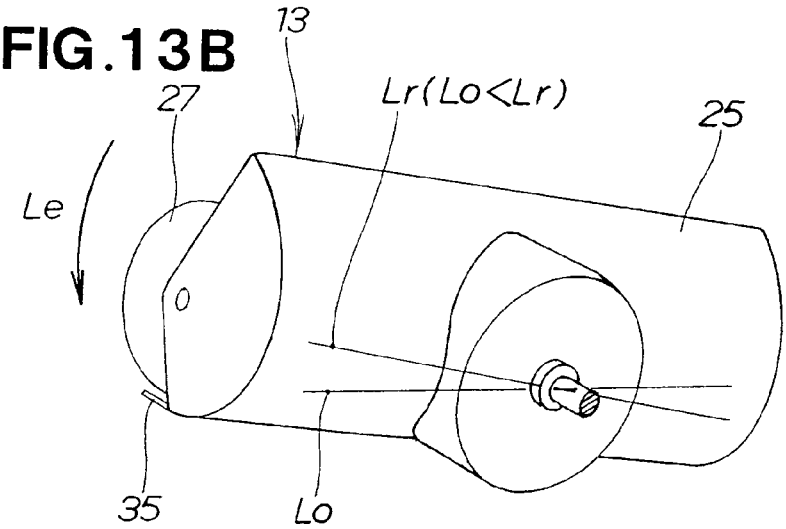
Figure 13C:
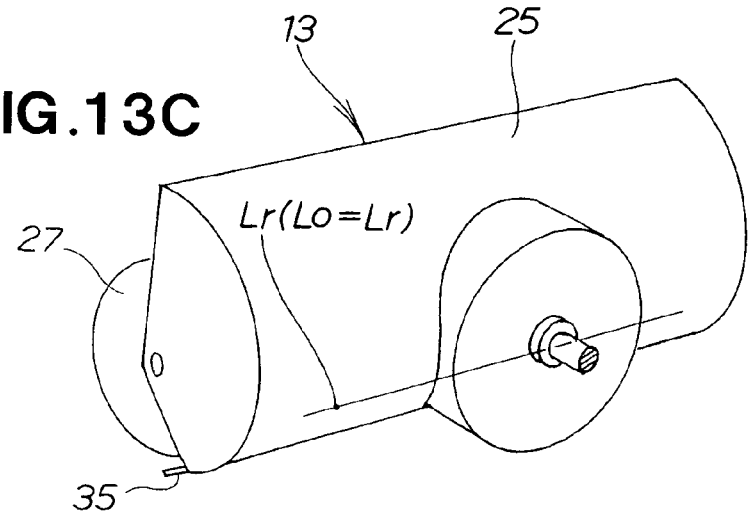

As shown in FIG. 13B, the process proceeds to ST28 when it is determined that the actual tilt position Lr is tilted downward and to the right with respect to the tilt reference position Lo (Lo<Lr), i.e., when it is determined that the right end of the auger housing 25 is lowered.

As shown in FIG. 13C, the process proceeds to ST29 when it is determined that the actual tilt position Lr matches the tilt reference position Lo (Lo=Lr), i.e., when it is determined that the auger housing 25 is horizontal.

ST27: The right-rolling relay 98 is turned ON.

ST28: The left rolling relay 97 is turned ON.

ST29: The left and right rolling relays 97 and 98 are turned OFF.

ST30A: It is determined whether conditions are satisfied wherein the actual height position Hr matches the last height position Hb (Hb=Hr), and the actual tilt position Lr matches the tilt reference position Lo (Lo=Lr). When YES, then the process returns to ST02. When NO, then the process returns to ST21.

The following is a summary of the above description of the modified example.

The control unit 61 issues (ST25, ST26A, and ST27 through ST29) an adjustment drive instruction to the rolling drive mechanism 38 so as to match the tilt Lr of the implement 13 to a pre-set rolling reference position Lo when it is determined (YES in both ST16 and ST18) that the aforementioned steering condition is no longer satisfied.

The auger housing 25 can therefore be automatically returned to the horizontal state when the machine is turned back and made to travel straight forward regardless of how the auger housing 25 is tilted immediately prior to turning of the snow remover 10. Automatically returning the auger housing 25 to the horizontal state in this manner makes it possible to re-adjust the tilt position of the implement 13 by a simple operation in which the housing is adapted to the terrain of a new area being cleared after the turn has been completed.

The snow-removing implement 13 in the present invention is not limited to a snow-removing unit provided with an auger 27, and may be provided with a snow-removing plow (snow-removing plate), for example.

Any turn-operation member may be used insofar as it can be operated to turn the travel units 11L and 11R, and the use of a pair of left and right turn operation levers 43L and 43R is not limiting. For example, it may be sufficient to provide at least one turn-operation member.

The tilt reference position Lo in the modified example is also not limited to having a value of "0," and any position may be set. Setting the tilt reference position Lo to an arbitrary position makes it possible to adapt the snow remover 10 to the terrain being cleared.

In the abovementioned control routines, the system in which the drive of the left and right electric motors 21L and 21R is controlled by the control unit 61 may be a pulse-width modulation system (PWM system) for feeding a pulse voltage to a motor terminal, for example. The motor drivers 84L and 84R may issue a pulse signal having a controlled pulse width in accordance with the control signal of the control unit 61 to control the rotation of the electric motors 21L and 21R.

The self-propelled snow remover 10 of the present invention is suitable as an auger-type snow remover whereby snow is gathered and removed by an auger at the front while the machine travels forward.

Obviously, various minor changes and modifications of the present invention are possible in light of the above teaching. It is therefore to be understood that with the scope of the appended claims the invention may be practiced otherwise than as specifically described.

What is claimed is:

1. A self-propelled snow remover comprising:

a machine body;

travel units mounted on the machine body to undergo turning movement and linear movement;

at least one steering member mounted to the machine body and operable to turn the travel units;

a snow-removing implement mounted to the machine body to undergo lifting, lowering and rolling movements relative to the machine body;

a lift drive mechanism that lifts and lowers the snow-removing implement; and a control unit that controls the lift drive mechanism by issuing a lift drive instruction to the lift drive mechanism so as to automatically lift the snow-removing implement when a steering condition in which the steering member is turned is determined to be satisfied, and by issuing a lowering drive instruction to the lift drive mechanism so as to automatically lower the snow-removing implement when the steering condition is determined to be no longer satisfied.

2. A self-propelled snow remover according to claim 1; wherein the control unit has a memory that stores a height position of the snow-removing implement at the time at which the steering condition is determined to be satisfied, and the control unit issues the lowering drive instruction for automatically returning a height position of the snow-removing implement to the stored height position when the steering condition is determined to be no longer satisfied.

3. A self-propelled snow remover according to claim 2; further comprising:

a rolling drive mechanism that rolls the snow-removing implement; and wherein the control unit has a memory that stores a rolling position of the snow-removing implement at the time at which the steering condition is determined to be satisfied, and the control unit issues an adjustment drive instruction to the rolling drive mechanism so as to automatically match a tilt of the snow-removing implement to the stored rolling position when the steering condition is determined to be no longer satisfied.

4. A self-propelled snow remover according to claim 2; further comprising:

a rolling drive mechanism that rolls the snow-removing implement; and wherein the control unit issues an adjustment drive instruction to the rolling drive mechanism so as to automatically match a tilt a rolling position of the snow-removing implement to a pre-set rolling reference position when the steering condition is determined to be no longer satisfied.

5. A self-propelled snow remover according to claim 1; further comprising: a rolling drive mechanism that rolls the snow-removing implement; and wherein the control unit has a memory that stores a rolling position of the snow-removing implement at the time at which the steering condition is determined to be satisfied, and the control unit issues an adjustment drive instruction to the rolling drive mechanism so as to automatically match a tilt of the snow-removing implement to the stored rolling position when the steering condition is determined to be no longer satisfied.

6. A self-propelled snow remover according to claim 5; wherein the rolling position of the snow-removing implement at the time at which the steering condition is determined to be satisfied is stored by the memory of the control unit during turning by the steering member.

7. A self-propelled snow remover according to claim 1; further comprising: a rolling drive mechanism that rolls the snow-removing implement; and wherein the control unit issues an adjustment drive instruction to the rolling drive mechanism so as to automatically match a tilt of the snow-removing implement to a pre-set rolling reference position when the steering condition is determined to be no longer satisfied.

8. A self-propelled snow remover according to claim 1; wherein the at least one steering member comprises a plurality of steering members.

9. A self-propelled snow remover according to claim 2; wherein the height position of the snow-removing implement at the time at which the steering condition is determined to be satisfied is stored by the memory of the control unit during turning by the steering member.

10. A self-propelled snow remover according to claim 3; wherein the rolling position of the snow-removing implement at the time at which the steering condition is determined to be satisfied is stored by the memory of the control unit during turning by the steering member.

11. A self-propelled snow remover comprising:

a machine body;

travel units mounted on the machine body to undergo turning movement during a turning operation;

at least one steering member mounted to the machine body and operable to turn the travel units during a turning operation;

a snow-removing implement mounted to the machine body to undergo lifting and lowering movements relative to the machine body;

a lift drive mechanism that lifts and lowers the snow-removing implement; and control means for controlling the lift drive mechanism to automatically lift the snow-removing implement during a turning operation by the steering member from a first height position to a second height position, and to automatically lower the snow-removing implement to the first height position when the turning operation by the steering member is stopped.

12. A self-propelled snow remover according to claim 11; wherein the control means comprises storing means for storing the first height position of the snow-removing implement during the turning operation by the steering member.

13. A self-propelled snow remover according to claim 11; further comprising a rolling drive mechanism that rolls the snow-removing implement; wherein the control means comprises storing means for storing a rolling position of the snow-removing implement during the turning operation by the steering member; and wherein the control means controls the rolling drive mechanism so that a tilt of the snow-removing implement is automatically matched to the stored rolling position when the turning operation by the steering member is stopped.

14. A self-propelled snow remover according to claim 11; further comprising a rolling drive mechanism that rolls the snow-removing implement; and wherein the control means controls the rolling drive mechanism so that a tilt of the snow-removing implement is automatically matched to a preset rolling reference position when the turning operation by the steering member is stopped.

15. A self-propelled snow remover according to claim 11; wherein the at least one steering member comprises a plurality of steering members.

16. A self-propelled snow remover comprising:

a machine body;

at least one travel unit mounted on the machine body for undergoing turning movement during a turning operation;

at least one steering member mounted to the machine body for performing a turning operation to turn the travel unit;

a snow-removing implement mounted to the machine body for undergoing lifting, lowering, and rolling movements relative to the machine body;

a lift drive mechanism for lifting and lowering the snow-removing implement;

a rolling drive mechanism for rolling the snow-removing implement; and a microcomputer that (a) executes a first control routine that controls the lift drive mechanism to automatically lift the snow-removing implement from an initial height position thereof when a steering condition in which the steering member performs a turning operation is determined to be satisfied and that controls the lift drive mechanism to automatically lower the snow-removing implement to the initial height position when the steering condition is determined to be no longer satisfied, and (b) executes a second control routine that controls the rolling drive mechanism to roll the snow-removing implement to a preselected rolling position when the steering condition is determined to be no longer satisfied.

17. A self-propelled snow remover according to claim 16; wherein the microcomputer executes the first and second control routines simultaneously.

18. A self-propelled snow remover according to claim 16; wherein the microcomputer comprises a memory that stores the initial height position of the snow-removing implement when the steering condition is determined to be satisfied.

19. A self-propelled snow remover according to claim 16; wherein the microcomputer comprises a memory that stores the preselected rolling position when the steering condition is determined to be satisfied.

20. A self-propelled snow remover according to claim 16; wherein the at least one travel unit comprises a plurality of travel unite mounted on the machine body for undergoing turning movement during a turning operation; and wherein the at least one steering member comprises a plurality of steering members mounted to the machine body for performing a turning operation to turn the travel units.

* * * * *